US009170529B2

(12) United States Patent
Fukamachi

(10) Patent No.: US 9,170,529 B2
(45) Date of Patent: Oct. 27, 2015

(54) PROCESS CARTRIDGE

(71) Applicant: Brother Kogyo Kabushiki Kaisha, Nagoya-shi, Aichi-ken (JP)

(72) Inventor: Yasuo Fukamachi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/577,576

(22) Filed: Dec. 19, 2014

(65) Prior Publication Data

US 2015/0104217 A1 Apr. 16, 2015

Related U.S. Application Data

(63) Continuation of application No. 13/597,994, filed on Aug. 29, 2012, now Pat. No. 8,938,187.

(30) Foreign Application Priority Data

Aug. 30, 2011 (JP) ..... 2011-186889

(51) Int. Cl.
*G03G 21/18* (2006.01)
*G03G 15/08* (2006.01)

(52) U.S. Cl.
CPC ..... *G03G 15/0867* (2013.01); *G03G 21/1821* (2013.01)

(58) Field of Classification Search
USPC ..... 399/90, 107, 110, 111, 113, 119, 120
See application file for complete search history.

(56) References Cited

U.S. PATENT DOCUMENTS

| | | | | |
|---|---|---|---|---|
| 7,643,770 | B2 * | 1/2010 | Sato et al. | 399/90 |
| 8,121,520 | B2 | 2/2012 | Okabe et al. | |
| 8,577,244 | B2 * | 11/2013 | Takagi et al. | 399/90 |
| 2006/0029418 | A1 | 2/2006 | Ishii et al. | |
| 2006/0029419 | A1 | 2/2006 | Shiraki | |
| 2006/0029420 | A1 | 2/2006 | Ishii et al. | |
| 2006/0029421 | A1 | 2/2006 | Ishii et al. | |
| 2006/0029422 | A1 | 2/2006 | Shiraki | |
| 2006/0029423 | A1 | 2/2006 | Shiraki | |
| 2011/0236060 | A1 | 9/2011 | Takagi | |

FOREIGN PATENT DOCUMENTS

| | | | |
|---|---|---|---|
| JP | 2006072284 | A | 3/2006 |
| JP | 2010-266893 | A | 11/2010 |
| JP | 2011203365 | A | 10/2011 |

OTHER PUBLICATIONS

Aug. 4, 2015—(JP) Notification of Reasons for Refusal—App 2011-186889.

* cited by examiner

*Primary Examiner* — Hoan Tran
(74) *Attorney, Agent, or Firm* — Banner & Witcoff, Ltd.

(57) ABSTRACT

A process cartridge includes: a drum cartridge including a photoconductor; a development cartridge configured to be detachably attached to the drum cartridge and including a developer carrying member for supplying developer to the photoconductor; a locking member provided on the drum cartridge and configured to be switchable between a locking position in which the development cartridge attached to the drum cartridge is in a locked state and restrained from being moved in a removing direction in which the development cartridge is removed from the drum cartridge and a lifting position in which the locked state is released and the development cartridge is movable in the removing direction, and a retaining member configured to retain the development cartridge which has been moved from the locked state in the removing direction by switching the locking member from the locking position to the lifting position.

12 Claims, 8 Drawing Sheets

PROCESS CARTRIDGE

CROSS-REFERENCE TO RELATED APPLICATION(S)

This application is a continuation of U.S. patent application Ser. No. 13/597,994, filed Aug. 29, 2012, which claims priority from Japanese Patent Application No. 2011-186889 filed on Aug. 30, 2011, the disclosures of which are incorporated herein by reference in their entirety.

TECHNICAL FIELD

The present invention relates to a process cartridge comprising a drum cartridge and a development cartridge detachably attached to the drum cartridge.

BACKGROUND ART

Conventionally, a process cartridge is known in the art, which includes a drum cartridge and a development cartridge detachably attached to the drum cartridge. To be more specific, this type of process cartridge includes a lock lever swingably supported on the drum cartridge.

The lock lever contacts with a part of the development cartridge in a state in which the development cartridge is attached to the drum cartridge, so that the development cartridge is locked to the drum cartridge to prevent disengagement of the development cartridge from the drum cartridge. When the user rotates the lock lever to unlock, the lock lever is released from the locked position to unlock the development cartridge from the drum cartridge.

In the aforementioned process cartridge, the development cartridge is unlocked from the drum cartridge only during the time that the user retains the rotated lock lever in the unlocked position. However, once the user releases his hand from the lock lever, the development cartridge is again locked to the drum cartridge by the lock lever. For this reason, the user has to remove the development cartridge from the drum cartridge by one hand, while operating the lock lever by the other hand. This leads to poor operability of the process cartridge.

SUMMARY OF THE INVENTION

In view of the above, it would be desirable to provide a process cartridge, which can ease the operation for removing the development cartridge from the drum cartridge.

According to the present invention, a process cartridge comprises: a drum cartridge including a photoconductor; a development cartridge configured to be detachably attached to the drum cartridge and including a developer carrying member for supplying developer to the photoconductor; a locking member provided on the drum cartridge and configured to be switchable between a locking position in which the development cartridge attached to the drum cartridge is in a locked state and restrained from being moved in a removing direction in which the development cartridge is removed from the drum cartridge and a lifting position in which the locked state is released and the development cartridge is movable in the removing direction; and a retaining member configured to retain the development cartridge which has been moved from the locked state in the removing direction by switching the locking member from the locking position to the lifting position.

BRIEF DESCRIPTION OF THE DRAWINGS

To better understand the claimed invention, and to show how the same may be carried into effect, reference will now be made, by way of example only, to the accompanying drawings, in which:

FIGS. 7A and 7B are schematic views showing a process cartridge according to a second embodiment of the present invention, in which FIG. 7A shows a locking member provided on the process cartridge in a locking position, and FIG. 7B shows the locking member in a lifting position.

DESCRIPTION OF EMBODIMENT

First Embodiment

Figure 1:
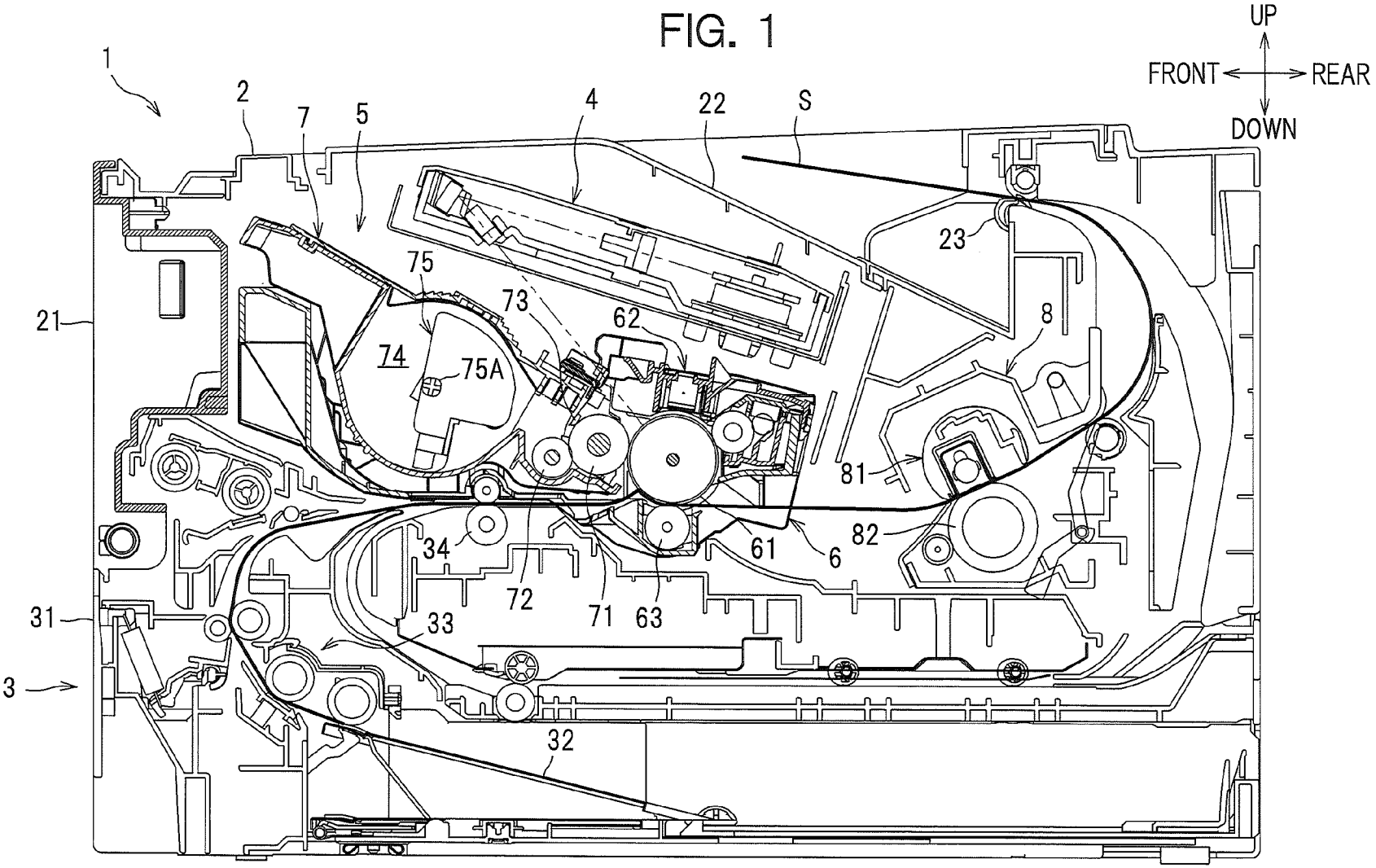
FIG. 1 is a schematic sectional view of a laser printer including a process cartridge according to a first embodiment of the present invention.

A detailed description will be given of a first embodiment of the present invention with reference to the accompanying drawings.

In the following description, a general arrangement of a laser printer comprising a process cartridge according to the first embodiment will be described, and thereafter characteristic features of the present invention will be described in detail.

In the following description, the direction is designated as from the viewpoint of a user who is using (operating) the laser printer. To be more specific, in FIG. 1, the left-hand side of the drawing sheet corresponds to the "front" side of the laser printer, the right-hand side of the drawing sheet corresponds to the "rear" side of the laser printer, the front side of the drawing sheet corresponds to the "right" side of the laser printer, and the back side of the drawing sheet corresponds to the "left" side of the laser printer. Similarly, the direction extending from top to bottom of the drawing sheet corresponds to the "vertical" or "upward-and-downward (up/down, upper/lower or top/bottom)" direction of the laser printer.

General Arrangement of Laser Printer

As seen in FIG. 1, a laser printer 1 includes a main body casing 2, and several components housed within the main body casing 2 which principally includes a sheet feeder unit 3 for feeding a sheet of paper (hereinafter simply referred to as a "sheet" S), an exposure device 4, a process cartridge 5 for transferring a toner image onto a sheet S, and a fixing device 8 for thermally fixing the toner image transferred onto the sheet S.

The sheet feeder unit 3 is provided in a lower space within the main body casing 2, and principally includes a sheet feed tray 31, a sheet pressure plate 32, and a sheet feed mechanism 33. Sheets S stored in the sheet feed tray 31 are urged upward by the sheet pressure plate 32, and supplied to the process cartridge 5 (between a photoconductor drum 61 and a transfer roller 63) by the sheet feed mechanism 33.

The exposure device 4 is provided in an upper space within the main body casing 2, and principally includes a laser beam emitter (not shown), a polygon minor, lenses, and reflecting mirrors, which are shown in the figure without reference numerals. The exposure device 4 is configured to cause a laser beam produced based upon image data and emitted from the laser beam emitter to travel along a path indicated by chain double-dashed line, so that a peripheral surface of the photoconductor drum 61 is rapidly scanned and illuminated consecutively with the laser beam.

The process cartridge 5 is disposed below the exposure device 4 within the main body casing 2, and configured to be installable in and removable from the main body casing 2 through an opening formed when a front cover 21 provided at the main body casing 2 is swung open. The process cartridge 5 includes a drum cartridge 6 and a development cartridge 7.

The drum cartridge 6 principally includes a photoconductor drum 61, a charger 62, and a transfer roller 63. The development cartridge 7 is configured to be detachably attached to the drum cartridge 6. The development cartridge 7 principally includes a development roller 71, a supply roller 72, a doctor blade 73, a toner reservoir 74 for storing toner, and an agitator 75 disposed in a toner storage chamber 74, which is an example of an agitating member.

In this process cartridge 5, the peripheral surface of the photoconductor drum 61 is uniformly charged by the charger 62, and then exposed to a rapidly sweeping laser beam from the exposure device 4. Therefore, the electric potential of the exposed area lowers so that an electrostatic latent image associated with image data is formed on the surface of the photoconductor drum 61. Meanwhile, toner in the toner reservoir 74 is agitated by the agitator 75 and supplied via the supply roller 72 to the development roller 71. The toner on the development roller 71 goes through between the development roller 71 and the doctor blade 73, so that a thin layer of toner having a predetermined thickness is carried on the development roller 71.

The toner carried on the development roller 71 is supplied from the development roller 71 to the electrostatic latent image formed on the photoconductor drum 61. Accordingly, the electrostatic latent image is visualized and a toner image is formed on the photoconductor drum 61. Thereafter, while a sheet S is conveyed through between the photoconductor drum 61 and the transfer roller 63, the toner image on the photoconductor drum 61 is transferred onto the sheet S.

The fixing device 8 is provided at the rear side of the process cartridge 5. The fixing device 8 principally includes a heating unit 81 and a pressure roller 82. The heating unit 81 includes a halogen heater, a fixing belt, and a nip plate, which are shown in the figure without reference numerals. The pressure roller 82 is configured to nip the fixing belt against the nip plate of the heating unit 81. In the fixing device 8, the toner image transferred onto the sheet S is thermally fixed on the sheet S while passing through between the heating unit 81 and the pressure roller 82. The sheet S with the toner image thermally fixed thereon is ejected by a sheet delivery roller 23 onto a sheet output tray 22.

Detailed Structure of Process Cartridge

As described above, the process cartridge 5 includes the drum cartridge 6, and the development cartridge 7 configured to be detachably attached to the drum cartridge 6.

Figure 2:
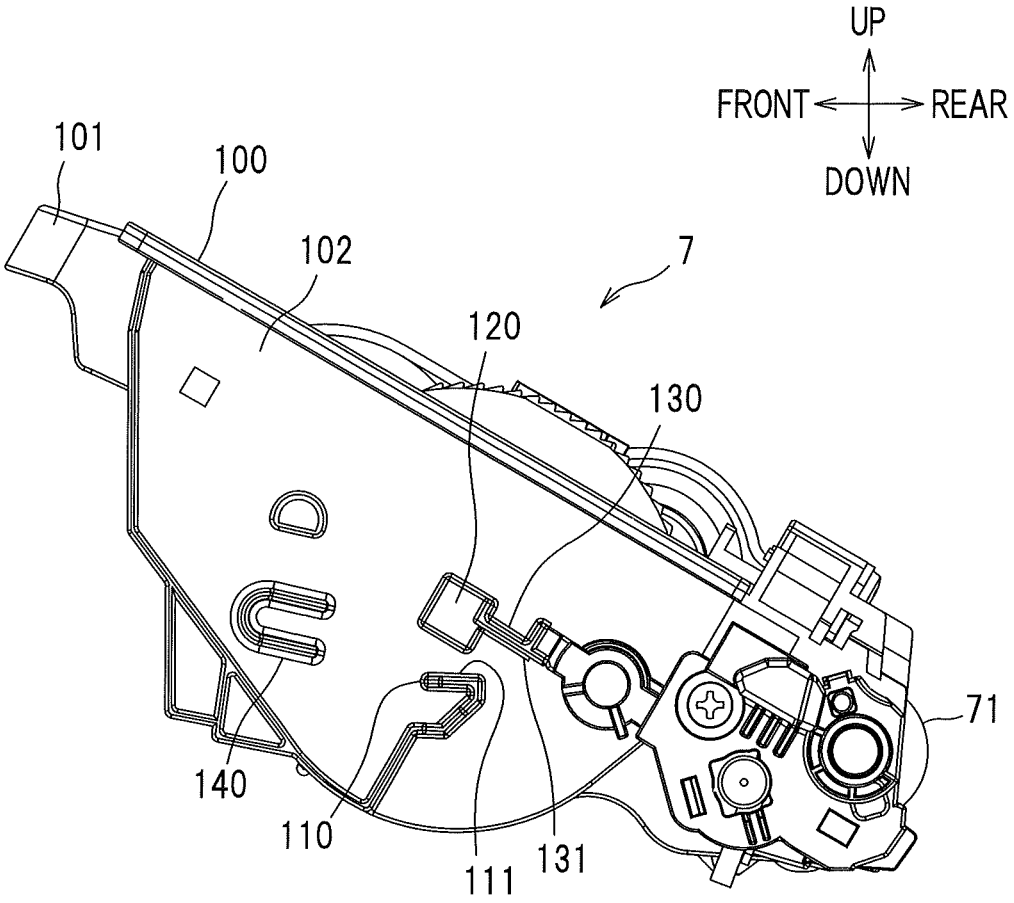
FIG. 2 is a side view of a development cartridge.

As seen in FIG. 2, the development cartridge 7 includes a holding portion 101 to be held by the user at a front end of the casing (development frame) 100, and the development roller 71 is rotatably supported at a rear end of the casing 100. Provided on the right-side wall 102 of the casing 100 are a locking rib 110, a protrusion 120, and a lifting rib 130. Abutment ribs 140 are formed respectively at the right-side wall 102 and the left-side wall (not shown) of the casing 100.

The locking rib 110 is formed as a thin plate-shaped protrusion extending outward from the right-side wall 102 of the casing 100. The locking rib 110 has a substantially horizontal surface 111 which extends in the front-and-rear direction and faces upward in a state in which the development cartridge 7 is attached to the drum cartridge 6.

The protrusion 120 is disposed above the locking rib 110 and extends outward from the right-side wall 102 of the casing 100. The protrusion 120 is arranged side by side with the rotary shaft (i.e., the center axis) of the agitator 75 in the right-and-left direction.

Figure 6A:
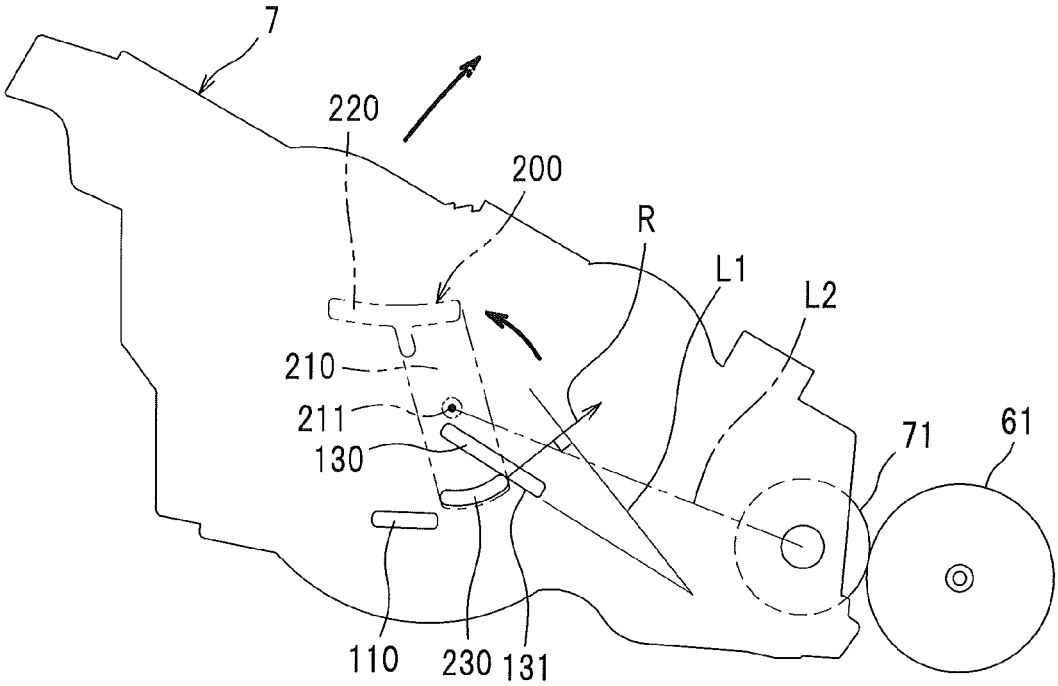
FIGS. 6A and 6B are views explaining an inclination angle of a contacting surface.

The lifting rib 130 is a thin plate-shaped protrusion disposed diagonally upward and rearward of the locking rib 110 at a rear side of the protrusion 120 and extending outward from the right-side wall 102 of the casing 100. The lifting rib 130 extends from the protrusion 120 toward the development roller 71 and includes a contacting surface 131 which faces diagonally downward and frontward. To be more specific, as best seen in FIG. 6A, the contacting surface 131 inclines at an angle closer to an inclination angle of a plane L2 connecting the axis of rotation of the development roller 71 and the axis of rotation of a lock lever 200 to be described later than to an inclination angle of a plane L1 orthogonal to a rotating direction R of the lock lever 200 at a contacting point between the lock lever 200 and the contacting surface 131.

Turning now to FIG. 2, the abutment rib 140 is a thin plate-shaped protrusion disposed frontward of the locking rib 110 and extending outward respectively from the right-side wall 102 and the left-side wall (not shown) of the casing 100. As seen in the right-and-left direction, the abutment rib 140 has a U-shaped configuration having a closed end facing forward.

Figure 3:
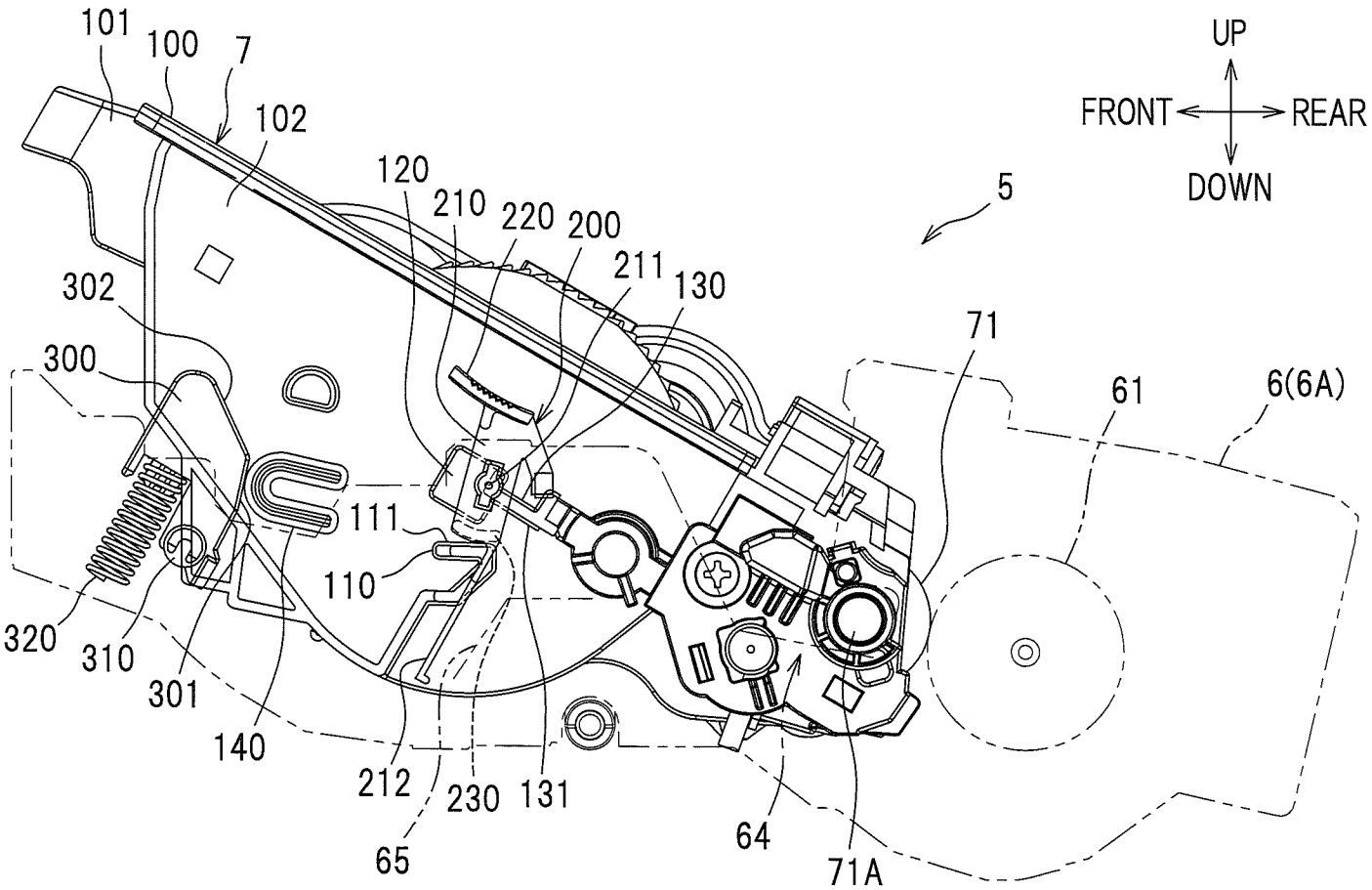
FIG. 3 shows the development cartridge attached to a drum cartridge.

As best seen in FIG. 3, the drum cartridge 6 principally includes a drum frame 6A, a photoconductor drum 61 rotatably supported at a rear side of the drum frame 6A, a pair of rocking arms 300 as an example of a pressing portion, and the lock lever 200 as an example of a locking member.

A pair of receiving portions 64 for receiving the rotary shaft 71A of the development roller 71 are formed at side walls of the drum frame 6A, in positions frontward of the photoconductor drum 61. As seen from side, each receiving portion 64 has a substantially U-shaped configuration with its front side open for receiving the rotary shaft 71A of the development roller 71.

The rocking arms 300 are rotatably supported at front end portions of right and left walls of the drum cartridge 6. Each rocking arm 300 has a center of rocking movement 310 supported by the drum cartridge 6. The rocking arm 300 extends substantially upward from the center of rocking movement 310, and includes a pressing surface 301 facing rearward, and a retaining surface 302 as an example of a retaining member, which extends diagonally upward and frontward from the upper end of the pressing surface 301 and faces diagonally upward and rearward. A coil spring 320 is provided at a front side of the center of rocking movement 310 of each rocking arm 300 to urge the rocking arm 300 in the clockwise direction of FIG. 3.

The urging force of the coil spring 320 is set such that, when the development cartridge 7 is disengaged from the drum cartridge 6 by operating the lock lever 200, the development cartridge 7 receives a force from the rocking arm 300 and pops up in a removing direction in which the development cartridge 7 is removed from the drum cartridge 6.

Figure 5:
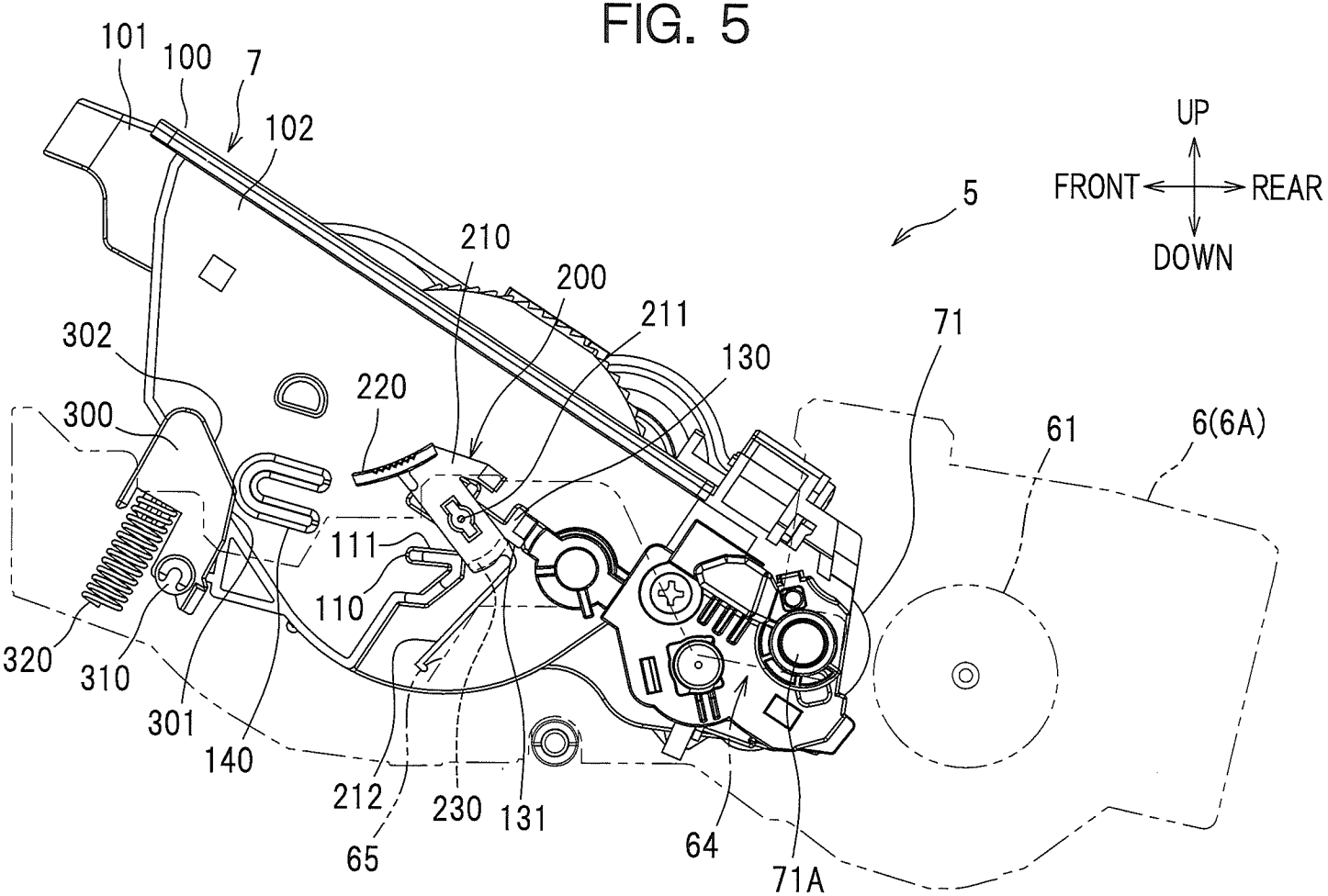
FIG. 5 is similar to FIG. 4, but shows a state in which the development cartridge has been displaced from the drum cartridge in a removing direction.

The lock lever 200 is configured to disengage the development cartridge 7 from the drum cartridge 6 by upwardly displacing that portion of the casing 100 (the development cartridge 7) which is provided with the agitator 75, while the rotary shaft 71A of the development roller 71 is received in the receiving portions 64. The lock lever 200 is configured to be movable between a locking position (as seen in FIG. 3) in which the development cartridge 7 attached to the drum cartridge 6 is in a locked state and restrained from being moved in the removing direction and a lifting position (as seen in FIG. 5) in which the locked state is released by rotating the lock lever 200 from the locking position and the development cartridge 7 is moved in the removing direction.

The lock lever 200 is provided on the right wall of the drum cartridge 6 between the photoconductor drum 61 and the rocking arm 300. To be more specific, as seen from the right-and-left direction, the lock lever 200 is rotatably supported at a position close to the rear end of the protrusion 120 of the development cartridge 7. In other words, the lock lever 200 is supported between the axis of rotation 75A of the agitator 75 and the development roller 71. A stopper (not shown) is provided to restrict the rotation of the lock lever 200 in the clockwise direction of the figure, so that the lock lever 200 is kept in the locking position unless the user operates the lock lever 200.

The lock lever 200 principally includes a main body portion 210, an operating lever 220 as an example of an operating portion, and a resin spring 212.

The main body portion 210 is a substantially rectangular plate member having a center portion 211 which is rotatably supported by the right wall of the drum cartridge 6. The main body portion 210 has a contact rib 230 as an example of a contact portion; the contact rib 230 extends in the front-and-rear direction along an edge of the main body portion 210, which is located in the lowermost position when the lock lever 200 is in the locking position.

The contact rib 230 is formed as a thin plate-shaped protrusion extending inward from the main body portion 210 toward the interior of the drum cartridge 6, that is, toward the development cartridge 7. The contact rib 230 has an arcuate shape which is concave toward the center portion of the main body portion 210.

Figure 6B:
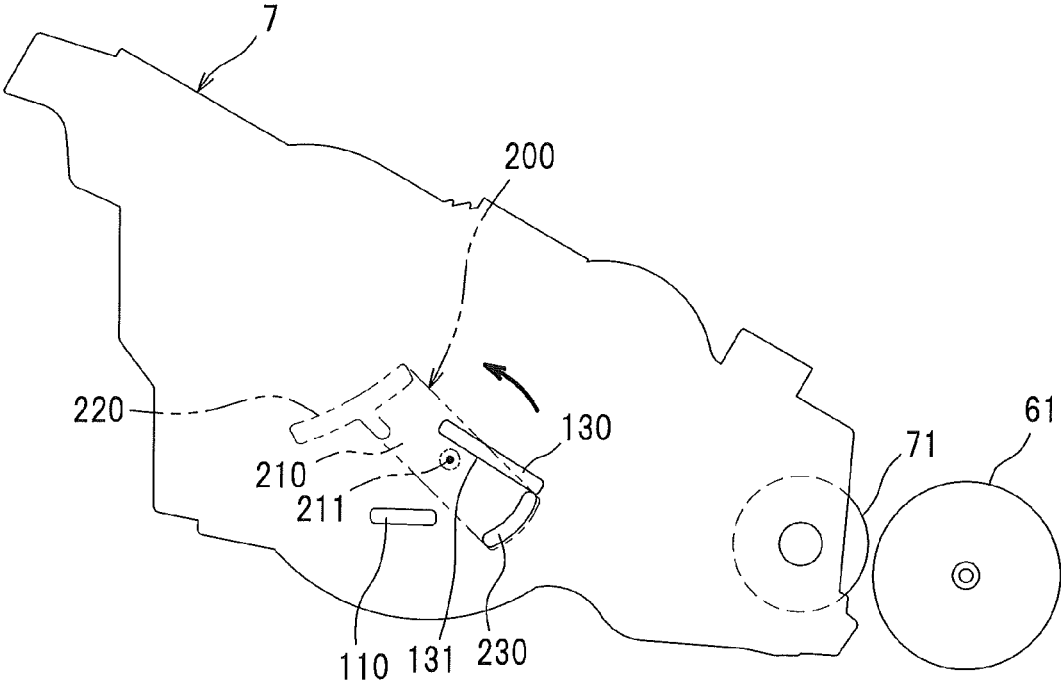

In the locked state, the contact rib 230 is located between the locking rib 110 and the protrusion 120 of the development cartridge 7 and engages with the surface 111 of the locking rib 110 from above, thereby restraining the development cartridge 7 from being moved in the removing direction. In the lifting position of the lock lever 200 as shown in FIGS. 5 and 6B, the contact rib 230 is positioned away from the locking rib 110, and the front end portion of the lock lever 200 in the rotating direction thereof comes into contact with the contacting surface 131 at a predetermined position between the center portion 211 of the main body portion 210 (the axis of rotation of the lock lever 200) and the development roller 71. In other words, in the lifting position of the lock lever 200, the front end portion of the contact rib 230 in the rotating direction of the lock lever 200 is located between the axis of rotation 75A of the agitator 75 and the development roller 71.

Turning now to FIG. 3, the operating lever 220 is disposed on the opposite edge of the main body portion 210, with respect to the center portion 211, from the contact rib 230 provided on the other edge. In the locked state, the operating lever 220 extends substantially in the front-and-rear direction and sticks out from the main body portion 210 in the forward direction. When the user depresses the operating lever 220 downward to release the locked state, the operating lever 220 causes the lock lever 200 to rotate in the anticlockwise direction of the figure (i.e., in a direction opposite to the removing direction in which the development cartridge 7 rotates to disengage from the drum cartridge 6) to thereby change the position of the lock lever 200 from the locking position to the lifting position.

Figure 4:
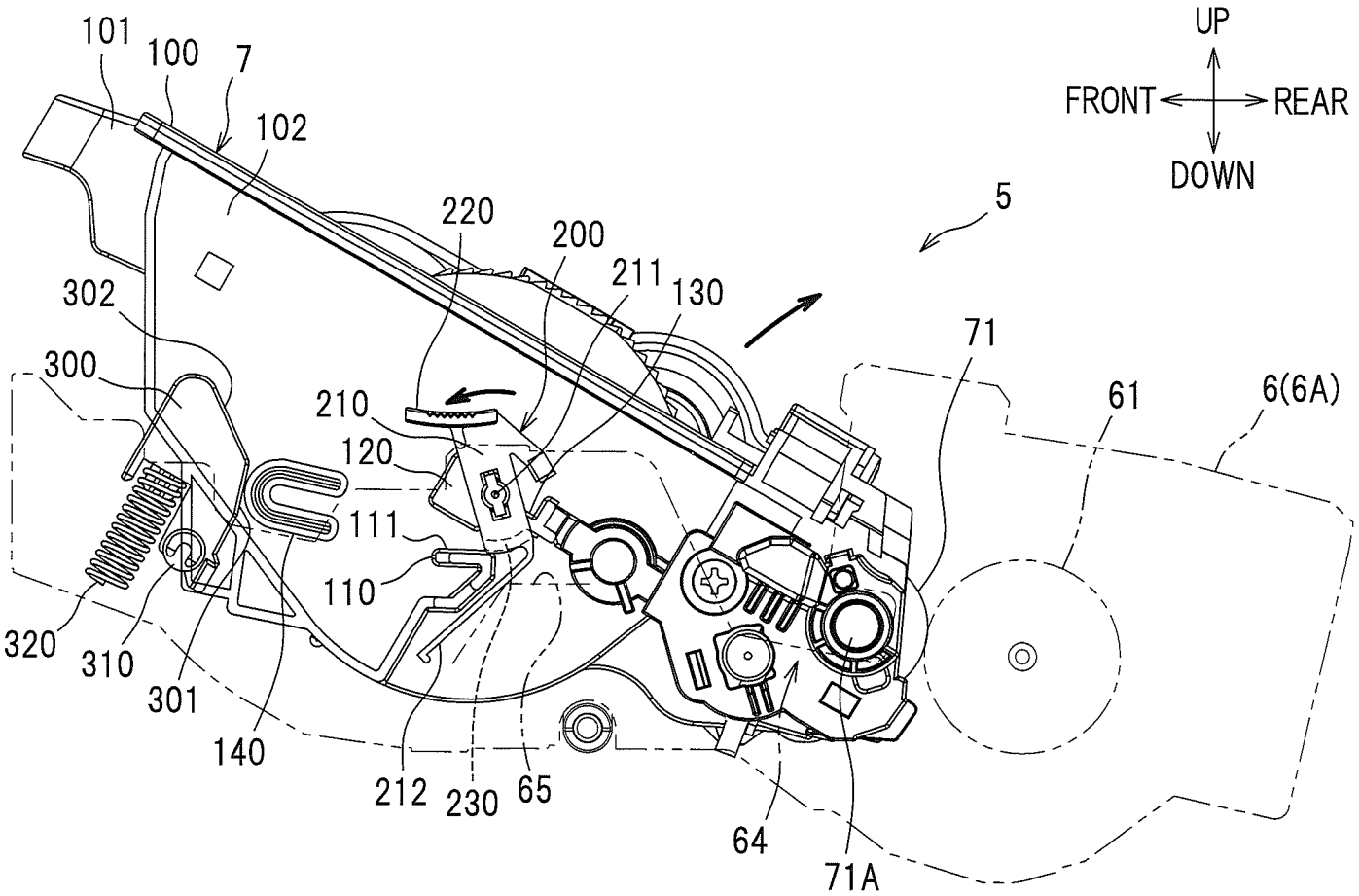
FIG. 4 is similar to FIG. 3, but shows a state in which a lock lever has been rotated with the development cartridge being attached to the drum cartridge.

The resin spring 212 is flexible and extends downward from the lower end of the main body portion 210. As best seen in FIG. 4, when the lock lever 200 is caused to rotate in the anticlockwise direction of the figure from the locking position to the lifting position, the resin spring 212 is brought into contact with a projection 65 formed on the inner wall of the drum cartridge 6 and deforms. Therefore, an urging force acts on the lock lever 200 having been moved in the lifting position so as to return into the locking position.

Operation and advantageous effects of the process cartridge 5 configured as described above will be described below.

As best seen in FIG. 3, when the development cartridge 7 is attached to the drum cartridge 6, the rocking arm 300 comes into contact with the abutment rib 140 of the development cartridge 7 from forward of the abutment rib 140. To be more specific, a pressing surface 301 of the rocking arm 300 contacts with the front end portion of the abutment rib 140, so that the abutment rib 140 is urged in the rearward direction by the urging force exerted by the coil spring 320. Accordingly, the development cartridge 7 is urged so that the development roller 71 is pressed against the photoconductor drum 61.

In this locking position of the lock lever 200, the contact rib 230 contacts with the surface 111 of the locking rib 110 provided on the development cartridge 7 from above the surface 111. Therefore, the lock lever 200 restricts the movement of the development cartridge 7 in the removing direction, and the development cartridge 7 is unable to be removed from the drum cartridge 6.

When the user operates the lock lever 200 by depressing the front end portion of the operating lever 220 downward, the lock lever 200 is caused to rotate in the anticlockwise direction of the figure. By this rotation of the lock lever 200, the contact rib 230 moves in the diagonally upward and rearward direction and is almost disengaged from the locking rib 110.

When the user moves the operating lever 220 of the lock lever 200 further in the same direction as shown in FIG. 5, the front end portion of the contact rib 230 comes into contact with the contacting surface 131 of the lifting rib 130 to push up the lifting rib 130. In this position, as seen in FIG. 6B, the contact rib 230 is remote from the locking rib 110 and located in a disengaged position, and thus the development cartridge 7 is displaced in the removing direction by a lifting force of the lock lever 200. Further, as best seen in FIG. 6A, when comparing the inclination angle of the contacting surface 131 with the inclination angle of a plane L1 that is orthogonal to the rotating direction R of the lock lever 200 at a contacting point between the lock lever 200 and the contacting surface 131, the inclination angle of the contacting surface 131 is more closely approximate to the inclination angle of a plane L2 connecting the axis of rotation of the development roller 71 and the axis of rotation of the lock lever 200. This ensures that a force from the contact rib 230 for pushing up the contacting surface 131 is transmitted to the contacting surface 131.

As best seen in FIG. 5, when the user rotates the lock lever 200 to a predetermined amount, the abutment rib 140 moves upward, so that the engagement between the abutment rib 140 and the pressing surface 301 of the rocking arm 300 is released. At this time, the rocking arm 300 rotates in the clockwise direction of the figure by the urging force of the coil spring 320, and the retaining surface 302 strongly presses the abutment rib 140 to push up the abutment rib 140. This causes the development cartridge 7 to pop up (although not shown in the figure), so that the user can easily recognize that the development cartridge 7 has been disengaged from the drum cartridge 6.

After the abutment rib 140 is popped up and drops on the retaining surface 302 of the rocking arm 300, the retaining surface 302 supports the abutment rib 140. Therefore, even if the lock lever 200 returns to the locking position from the lifting position, the retaining surface 302 can retain the development cartridge 7 in a released state. As described above, since the process cartridge 5 includes the retaining surface 302 configured to retain the development cartridge 7 which has been disengaged from the drum cartridge 6 by the operation of the lock lever 200, the user first operates the lock lever 200 by one hand and then he can easily remove the development cartridge 7 from the drum cartridge 6 by holding the holding portion 101 of the development cartridge 7 using the same hand.

Further, instead of providing the lock lever 200 at the front side of the drum cartridge 6, the lock lever 200 is located between the axis of rotation 75A of the agitator 75 and the development roller 71, particularly, in a position close to a contact line between the development roller 71, which is a rotation center of the development cartridge 7, and the photoconductor drum 61. Therefore, the development cartridge 7 displaces in the removing direction to a large amount even if the amount of displacement of the lock lever 200 is small.

Further, the rocking arm 300 has the retaining surface 302 configured to retain the development cartridge 7 disengaged from the drum cartridge 6. This can reduce the number of constituent parts as compared with a configuration in which a separate member for retaining the development cartridge 7 disengaged from the drum cartridge 6 is provided other than the rocking arm 300.

Second Embodiment

A detailed description will be given of a second embodiment of the present invention with reference to the accompanying drawings.

Whereas the locking member and the retaining member are provided discretely in the first embodiment, the locking member and the retaining member are formed as a single part in this embodiment.

In this embodiment, parts similar to those previously described in the first embodiment are denoted by the same reference numerals and detailed description thereof will be omitted.

Figure 7A:
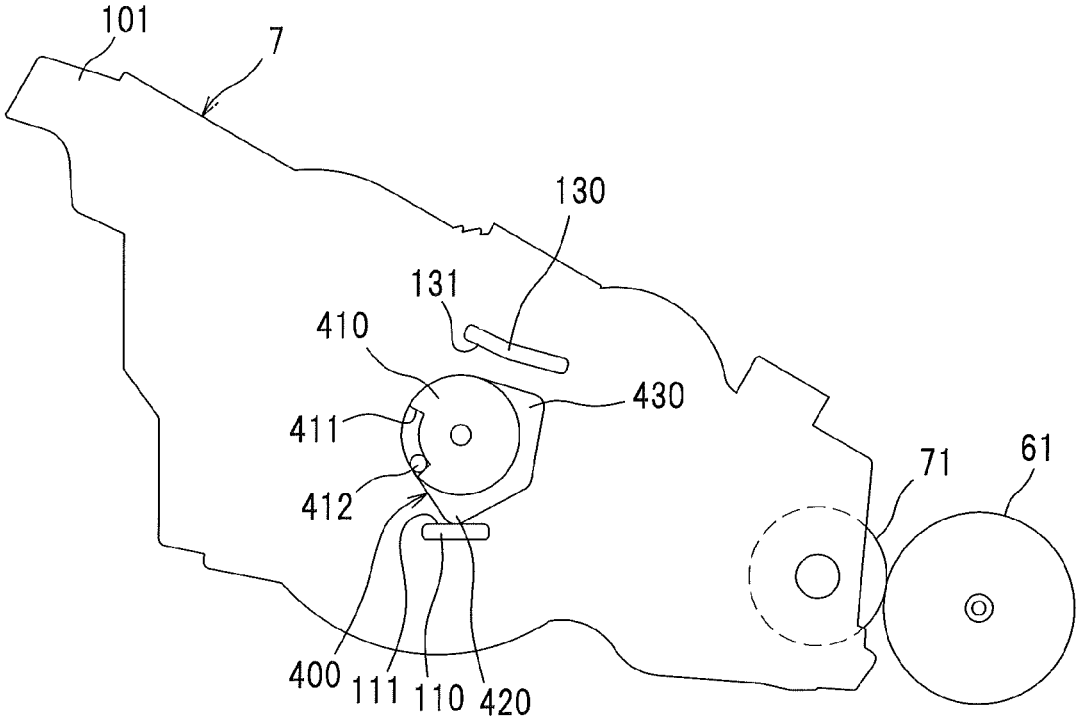

As seen in FIG. 7A, a locking rib 110 and a lifting rib 130 are formed on a side wall of the development cartridge 7.

The locking rib 110 is disposed below a locking member 400 to be described later. The locking rib 110 has a surface 111 which faces upward.

The lifting rib 130 is disposed above the locking member 400 to be described later. The lifting rib 130 has a contacting surface 131 which faces diagonally downward and frontward.

Figure 7B:
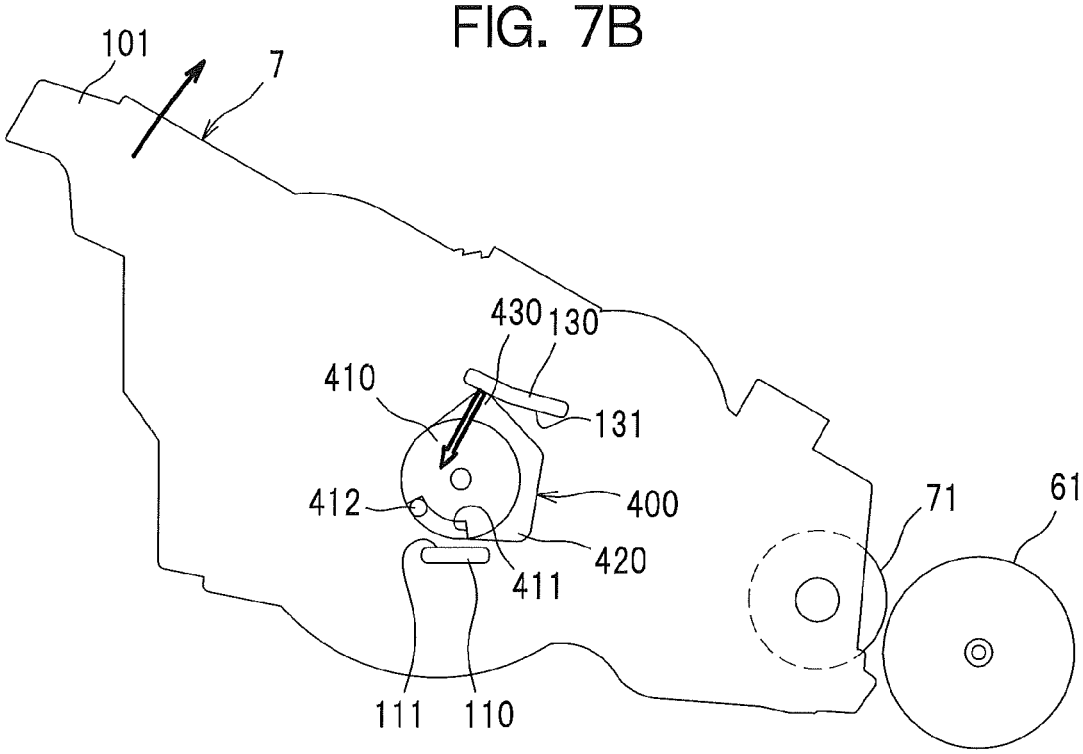

The locking member 400 is configured to be switchable between a locking position (as seen in FIG. 7A) in which the development cartridge 7 attached to the drum cartridge 6 is in a locked state and restrained from being moved in the removing direction and a lifting position (as seen in FIG. 7B) in which the locked state is released and the development cartridge 7 is movable in the removing direction.

The locking member 400 principally includes a main body portion 410, a locking protrusion 420, and a lifting protrusion 430 as an example of a contact portion.

Figure 8:
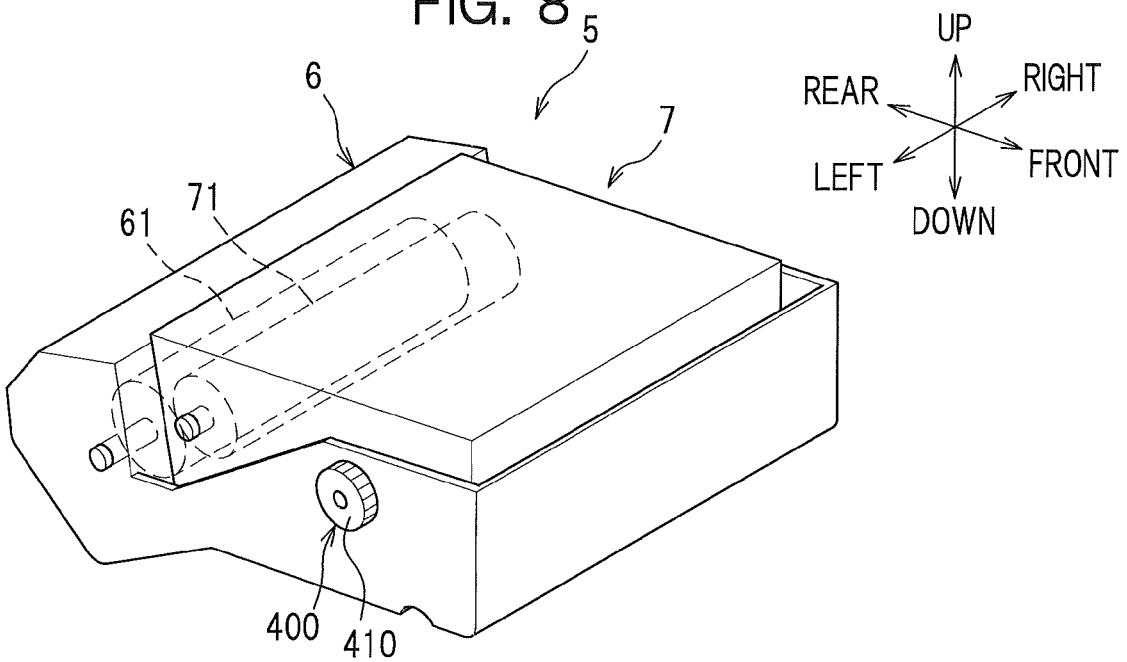
FIG. 8 is a perspective view of the process cartridge according to the second embodiment.

The main body portion 410 includes two circular plates, one of which is provided inside the drum cartridge 6 on a left wall thereof and, as best seen in FIG. 8, the other one of which is provided outside the drum cartridge 6 on the left wall thereof. The two circular plates are connected by a connecting shaft which is shown in the figure without a reference numeral. The main body portion 410 is rotatably supported by the drum cartridge 6.

As best seen in FIG. 7A, the main body portion 410 disposed inside the drum cartridge 6 has a groove 411 at a surface facing to the drum cartridge 6. The groove 411 is formed in a circumferential direction along an edge of the main body portion 410. The groove 411 is formed such that a projection 412 to be described later is brought into contact with a lower end portion of the groove 411 when the locking member 400 is in the locking position, whereas the projection 412 is bought into contact with an upper end portion of the groove 411 when the locking member 400 is in the lifting position.

The locking protrusion 420 is formed as a protrusion having a substantially triangular configuration as seen from side. To be more specific, the locking protrusion 420 extends from the main body portion 410 such that it protrudes in the downward direction while the locking protrusion 420 is in the locked state. In the locked state, the locking protrusion 420 engages with the surface 111 of the locking rib 110 from above, thereby restraining the development cartridge 7 from being moved in the removing direction.

The lifting protrusion 430 is formed as a protrusion having a substantially triangular configuration as seen from side. To be more specific, the lifting protrusion 430 extends and protrudes from the main body portion 410 at a position downstream from the locking protrusion 420 in the rotating direction of the main body portion 410. In the lifting position of the locking member 400 as shown in FIG. 7B, the lifting protrusion 430 comes into contact with the contacting surface 131 of the lifting rib 130 of the development cartridge 7 and pushes up the lifting rib 130.

As best seen in FIGS. 7A and 7B, a projection 412 is formed on the inner surface of the drum cartridge 6. The projection 412 sticking out toward the development cartridge 7 is engageable with the groove 411.

In the process cartridge 5 according to the second embodiment, while the development cartridge 7 is attached to the drum cartridge 6, the locking protrusion 420 of the locking member 400 engages with the surface 111 of the locking rib 110 from above. This can restrain the development cartridge 7 from being moved in the removing direction.

When the user rotates the main body portion 410 of the locking member 400 in the anticlockwise direction of the figure, the engagement between the locking protrusion 420 and the locking rib 110 is released. When the user further rotates the locking member 400, the lifting protrusion 430 comes into contact with the contacting surface 131 of the lifting rib 130 to push up the lifting rib 130, so that the development cartridge 7 is moved in the removing direction.

As best seen in FIG. 7B, when the user rotates the main body portion 410 of the locking member 400 until the projection 412 is brought into contact with one end portion of the groove 411 positioned in an upstream side in the rotating direction of the main body portion 410, a force acts on the lifting protrusion 430 (see outline arrow in FIG. 7B) in such a direction as to rotate the locking member 400 in the anticlockwise direction of the figure. This is, because the contacting surface 131 of the lifting rib 130 faces diagonally downward and frontward and the force acts on the lifting protrusion 430 in a position frontward of an axis of rotation of the main body portion 410. However, since the projection 412 contacts with the end portion of the groove 411 positioned in the upstream side in the rotating direction of the main body portion 410, the locking member 400 is retained in the position shown in FIG. 7B. Namely, the lifting protrusion 430 operates as a retaining member for retaining the development cartridge 7 disengaged from the drum cartridge 6 in the released state.

Therefore, as with the first embodiment, since the process cartridge 5 according to the second embodiment includes the lifting protrusion 430 configured to retain the development cartridge 7 which has been disengaged from the drum cartridge 6 and moved in the removing direction by the operation of the locking member 400, the user first operates the locking member 400 by one hand and then he can easily remove the development cartridge 7 from the drum cartridge 6 by holding the holding portion 101 of the development cartridge 7 using the same hand and pulling the development cartridge 7 in the forward direction.

Although illustrative embodiments of the present invention have been described in detail, the present invention is not limited to these specific embodiments. It is to be understood that various changes and modifications may be made without departing from the scope of the appended claims.

In the above exemplary embodiments, the photoconductor drum 61 is employed as an example of a photoconductor. However, the present invention is not limited to this specific configuration. For example, a belt-type photoconductor may be employed.

Further, in the above exemplary embodiments, the process cartridge 5 according to the present invention is adapted to the laser printer 1. However, the present invention is applicable to other image forming apparatuses such as a copying machine and a multifunction peripheral.

What is claimed is:

1. A developing cartridge configured to be attached to a drum cartridge, the developing cartridge comprising:

a developing roller configured to rotate about an axis extending in an axis direction;

a housing configured to accommodate developer therein, the housing including a first wall and a second wall separated from the first wall in the axis direction, the developing roller being rotatably disposed between the first wall and the second wall;

a locking rib provided on an outer surface of the first wall, the locking rib configured to be locked by a first portion of the drum cartridge in a locking position in which the developing cartridge is attached to the drum cartridge;

a lifting rib provided on an outer surface of the first wall, the lifting rib configured to be lifted by a second portion of the drum cartridge from the locking position to a lifting position; and an abutment rib provided on an outer surface of the first wall, the abutment rib configured to be retained in the lifting position by a third portion of the drum cartridge.

2. The developing cartridge according to claim 1, wherein the lifting rib includes a surface, and the lifting rib is configured to be lifted from the locking position to the lifting position in a case where the surface is contacted by the second portion of the drum cartridge.

3. The developing cartridge according to claim 1, wherein the locking rib, the lifting rib and the abutment rib are different from each other.

4. The developing cartridge according to claim 1, wherein the locking rib, the lifting rib and the abutment rib are provided at different positions, respectively.

5. A developing cartridge configured to be attached to a drum cartridge, the developing cartridge comprising:

a developing roller configured to rotate about an axis extending in an axis direction;

a housing configured to accommodate developer therein, the housing including a first wall and a second wall separated from the first wall in the axis direction, the developing roller being rotatably disposed between the first wall and the second wall;

a first protrusion protruding from an outer surface of the first wall outwardly, the first protrusion configured to be locked by a first portion of the drum cartridge in a locking position in which the developing cartridge is attached to the drum cartridge;

a second protrusion protruding from an outer surface of the first wall outwardly, the second protrusion configured to be lifted by a second portion of the drum cartridge from the locking position to a lifting position; and a third protrusion protruding from an outer surface of the first wall outwardly, the third protrusion configured to be retained in the lifting position by a third portion of the drum cartridge.

6. The developing cartridge according to claim 5, wherein the second protrusion includes a surface, and the second protrusion is configured to be lifted from the locking position to the lifting position in a case where the surface is contacted by the second portion of the drum cartridge.

7. The developing cartridge according to claim 5, wherein the first protrusion, the second protrusion and the third protrusion are different from each other.

8. The developing cartridge according to claim 5, wherein the first protrusion, the second protrusion and the third protrusion protruding from different positions on an outer surface of the first wall, respectively.

9. A developing cartridge configured to be attached to a drum cartridge, the developing cartridge comprising:

a first protrusion protruding from an outer surface of the developing cartridge outwardly, the first protrusion configured to be locked by a first portion of the drum cartridge in a locking position in which the developing cartridge is attached to the drum cartridge;

a second protrusion protruding from an outer surface of the developing cartridge outwardly, the second protrusion configured to be lifted by a second portion of the drum cartridge from the locking position to a lifting position; and a third protrusion protruding from an outer surface of the developing cartridge outwardly, the third protrusion configured to be retained in the lifting position by a third portion of the drum cartridge.

10. The developing cartridge according to claim 9, wherein the second protrusion includes a surface, and the second protrusion is configured to be lifted from the locking position to the lifting position in a case where the surface is contacted by the second portion of the drum cartridge.

11. The developing cartridge according to claim 9, wherein the first protrusion, the second protrusion and the third protrusion are different from each other.

12. the developing cartridge according to claim 9, wherein the first protrusion, the second protrusion and the third protrusion protruding from different positions on an outer surface of the developing cartridge, respectively.

* * * * *